US006206778B1

(12) United States Patent
Smith

(10) Patent No.: US 6,206,778 B1
(45) Date of Patent: Mar. 27, 2001

(54) AIR DIFFUSER PLENUM

(76) Inventor: Randall L. Smith, 1519 Rowewood Dr., Chattanooga, TN (US) 37421

( * ) Notice: Subject to any disclaimer, the term of this patent is extended or adjusted under 35 U.S.C. 154(b) by 0 days.

(21) Appl. No.: 09/489,402

(22) Filed: Jan. 21, 2000

(51) Int. Cl.[7] ..... F24F 13/06
(52) U.S. Cl. ..... 454/292; 454/306; 454/330
(58) Field of Search ..... 454/284, 292, 454/299, 306, 330; 62/DIG. 16

(56) References Cited

U.S. PATENT DOCUMENTS 1,069,103 * 8/1913 Beery ..... 454/306 X
3,319,558 * 5/1967 Bodian ..... 454/299 X
4,048,910 * 9/1977 Weor ..... 62/16 X

FOREIGN PATENT DOCUMENTS 39 31 967 * 7/1979 (DE) ..... 454/292
675280 * 7/1979 (RU) ..... 454/299

* cited by examiner

*Primary Examiner*—Harold Joyce
(74) *Attorney, Agent, or Firm*—Miller & Martin LLP

(57) ABSTRACT

An air diffuser plenum for use with climate control systems to direct air to desired locations within the interior of a building. An inlet receives air from the climate control system. Within the air diffuser plenum is a cavity which receives the incoming air. The bottom of the housing has a deflector which is formed from the interior sides of a bottom portion of the diffuser. The deflector directs air from the cavity to outlets connected to the sides of the diffuser. Since the deflector is formed from the opposing sides of the bottom portion of the diffuser, there is no need for a separate bottom plate to hold a diffuser insert in place. Additionally, the deflector may extend a distance beyond the side wall intersection to direct air in direction.

16 Claims, 13 Drawing Sheets

PRIOR ART

PRIOR ART

PRIOR ART

PRIOR ART

PRIOR ART

AIR DIFFUSER PLENUM

BACKGROUND OF THE INVENTION

1. Field of the Invention

The present invention relates, in general, to the area of heating, ventilating and air-conditioning systems including the components which are located at outlets through which air is supplied to a space to be ventilated or the like by the system. More specifically, this invention relates to an air diffuser plenum which may be used in a roof-mounted climate control system.

2. Description of Related Art

Climate control systems such as heating, ventilation and air-conditioning systems (HVAC systems) are often utilized in buildings to provide a comfortable climate within the building. Some buildings utilize ducts within the building to direct air from a climate control unit to specific locations for further distribution throughout a desired space. Other buildings may utilize multiple climate control units in a system in an effort to minimize the length and quantity of ducts within the building. In some buildings, especially buildings of a commercial nature, such as warehouse-type retail stores, the climate control system, often comprising a number of climate control units, are mounted on the roof. Preferably the roof is a flat roof immediately above a living or working space, although the air diffuser plenum of the preferred embodiments could be utilized in conjunction with pitched roofs and/or ductwork.

At least four different air diffuser plenum designs are known in the prior art. In all of these known designs, air is directed from a climate control system, through a curb in the roof, into at least one transition duct, and into the air diffuser plenum. Once the air enters the prior art air diffuser plenums, it contacts a diffuser insert which directs air out of vents located on the sides of the diffusers. The bottom portion of the prior art air diffuser plenums are substantially planar. On top of this substantially planar bottom portion is where an air diffuser insert is positioned during construction of these prior art diffuser plenums. Once the diffuser insert is positioned within the diffuser at the desired location, the bottom panel is connected to the sides to hold the diffuser assembly in place. The diffuser insert in these designs is contained within the sides of the diffuser housing. Insulation is often used on top of the bottom panel to reduce or eliminate condensation from forming on the bottom surface of the bottom panel.

In many buildings constructed today, the plurality of climate control units creates the requirement for a number of diffusers per building. Accordingly, the elimination of some sheet metal from the construction of air diffusers will likely result in a cost savings in material to the manufacturer of air diffuser plenums.

Furthermore, a need exists for a more efficient air diffuser capable of more precisely directing air than has been known in the prior art.

It is therefore desirable, to have an improved air diffuser plenum.

BRIEF SUMMARY OF THE INVENTION

The present invention is an air diffuser plenum for use with climate control systems to direct air to desired locations within the interior of a building. An inlet receives air from the climate control system. Within the air diffuser plenum is a cavity which receives the incoming air. The bottom of the housing has a deflector which is formed from the opposing side of a bottom portion of the diffuser. The deflector directs air from the cavity to outlets connected to the sides of the diffuser. Since the deflector is formed from the interior sides of the bottom portion of the diffuser, there is no need for a separate bottom plate to hold a diffuser insert in place. Additionally, the deflector may extend a distance beyond the side wall intersections to direct air in a precise direction.

It is an object of the present invention to provide an air diffuser plenum having a deflector rather than a diffuser insert.

It is a further object of the present invention to reduce the amount of construction materials required to form an air diffuser.

Another object of the invention is to provide efficient distribution of air to a desired location.

BRIEF DESCRIPTION OF THE SEVERAL VIEWS OF THE DRAWING

The particular features and advantages of the invention as well as other objects will become apparent from the following description taken in connection with the accompanying drawings in which.

DETAILED DESCRIPTION OF THE INVENTION

Figure 1A:
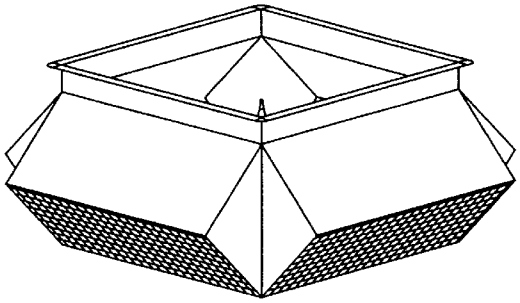
Fig. 1A PRIOR ART
FIG. 1A is a top perspective view of a first prior art diffuser design.
Figure 1D:
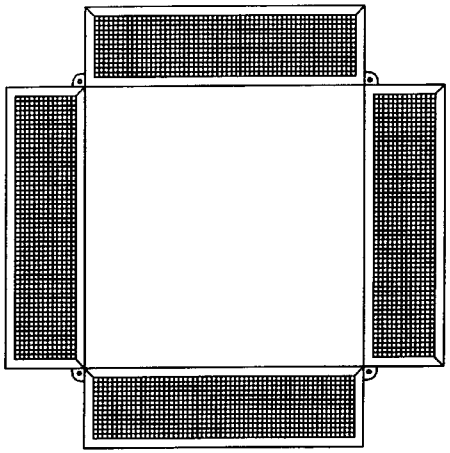
Fig. 1D PRIOR ART
FIG. 1D is a bottom plan view of the diffuser of FIG. 1A.
Figure 1B:
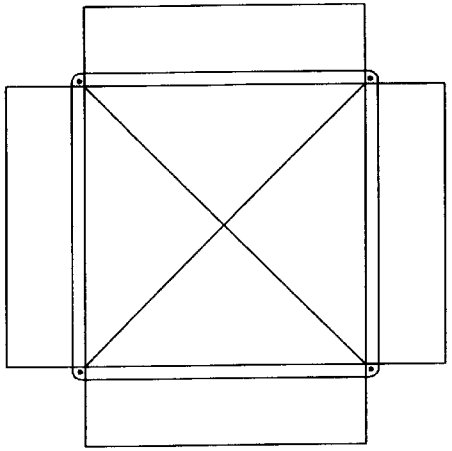
Fig. 1B PRIOR ART
FIG. 1B is a top plan view of the diffuser of FIG. 1A.
Figure 1C:
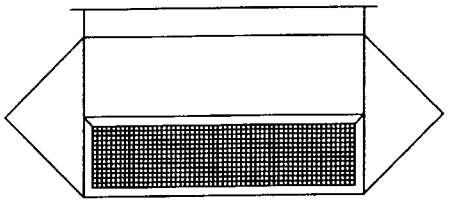
FIG. 1C is a side plan view of the diffuser of FIG. 1A.
Figure 2D:
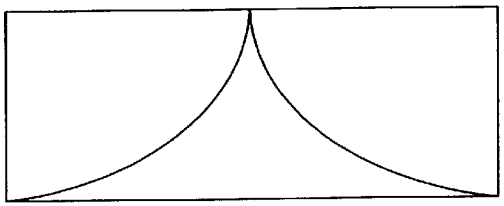
Fig. 2D PRIOR ART
FIG. 2D is a side plan view of the insert of FIG. 2A.
Figure 2E:
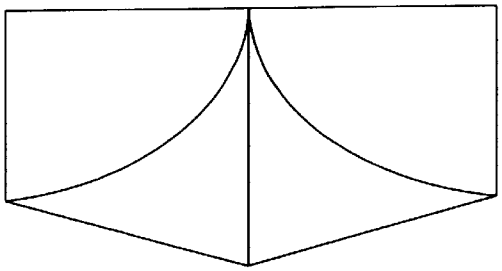
Fig. 2E PRIOR ART
FIG. 2E is a side plan view of the insert of FIG. 2A, with the insert turned 45 degrees relative to the view of 2D.
Figure 2A:
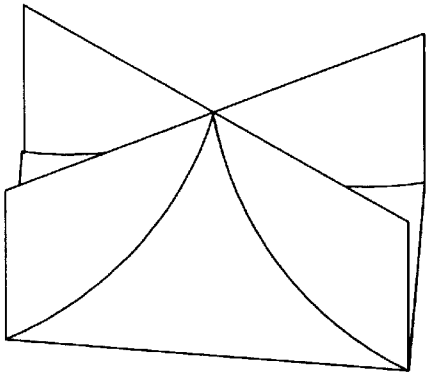
Fig. 2A PRIOR ART
FIG. 2A is a top perspective view of a prior art diffuser insert.
Figure 2C:
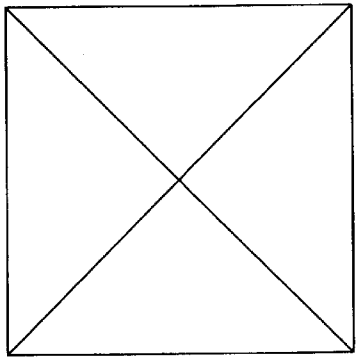
Fig. 2C PRIOR ART
FIG. 2C is a bottom plan view of the insert of FIG. 2A.
Figure 2B:
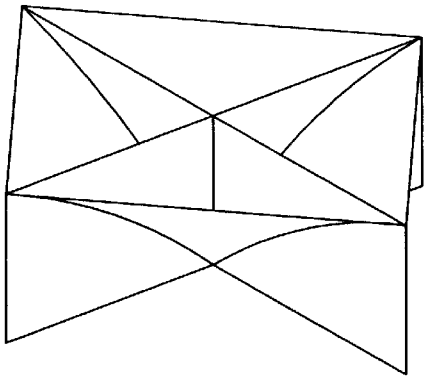
FIG. 2B is a bottom perspective view of the insert of FIG. 2A.

FIGS. 1–5 are directed to the prior art.

Referring to FIGS. 6A–6D, a diffuser 10 of the presently preferred embodiment is illustrated. This diffuser is a "four-way" diffuser as it is capable of directing air in four separate directions or ways. This device in its preferred mode of operation would be connected to at least one duct such as a transitions, or a transition duct (shown in phantom in FIG. 6B). The transition duct communicates through a roof curb into a climate control system, such as an HVAC system. Thus air from an HVAC unit could be delivered to the interior of a building through the diffuser 10. The diffuser 10 could also be connected to other duct designs for use in other climate control systems.

The diffuser is preferably constructed from a sheet metal material of a workable thickness as is known in the art. The sections of sheet metal utilized to construct the diffuser 10 may be cut out from a pattern or burned out with a computer controlled plasma cutting table. Intersections of different sections of sheet metal may occur through bending of a piece of sheet metal or through joining two pieces of sheet metal together such as by welding.

In operation, air is delivered into the diffuser 10 through inlet 12. The diffuser 10 has a housing 11 having an inlet 12 and a cavity 16 therein. As best seen in FIG. 6A, within the sides 14 of the diffuser 10 is a cavity 16. From the cavity 16, air is expelled out of vents 18 (shown in phantom). The vents 18 are illustrated in phantom. Some air may enter the inlet 12 along axis 64.

Figure 3A:
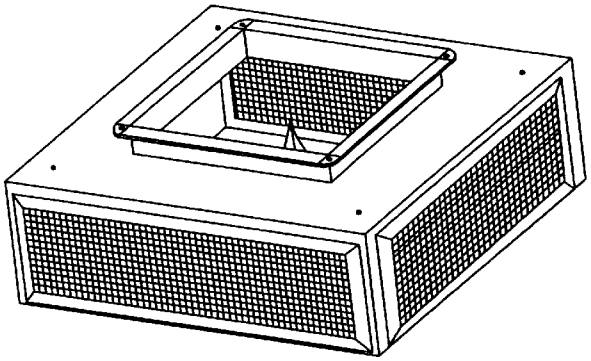
Fig. 3A PRIOR ART
FIG. 3A is a top perspective view of a second prior art diffuser design.
Figure 3D:
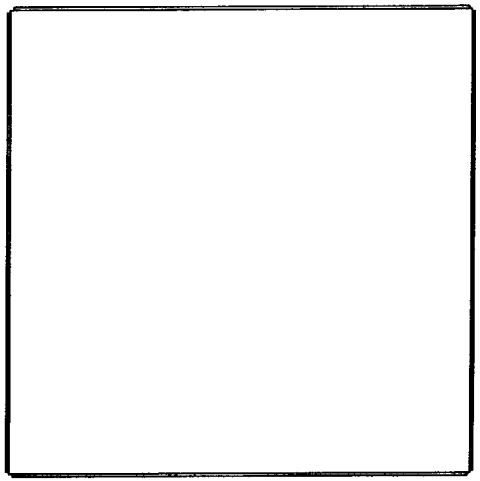
Fig. 3D PRIOR ART
FIG. 3D is a bottom plan view of the diffuser of FIG. 3A.
Figure 3B:
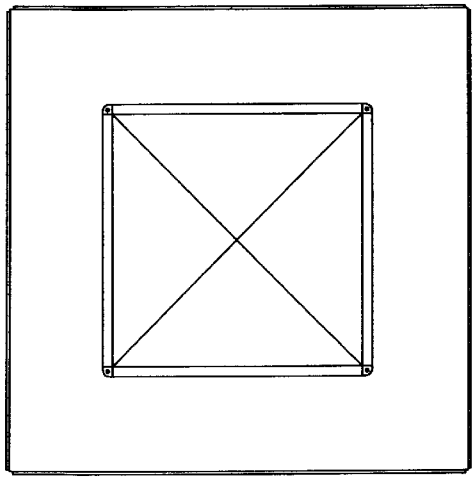
Fig. 3B PRIOR ART
FIG. 3B is a top plan view of the diffuser of FIG. 3A.
Figure 3C:
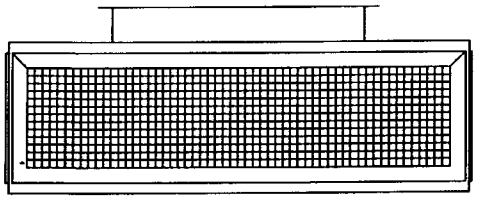
FIG. 3C is a side plan view of the diffuser of FIG. 3A.
Figure 4A:
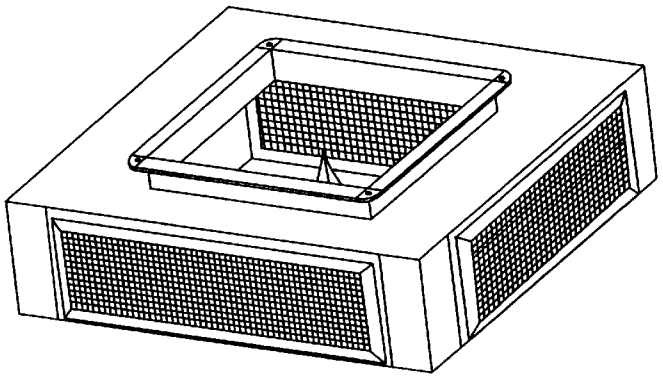
Fig. 4A PRIOR ART
FIG. 4A is a top perspective view of a third prior art diffuser design.
Figure 4D:
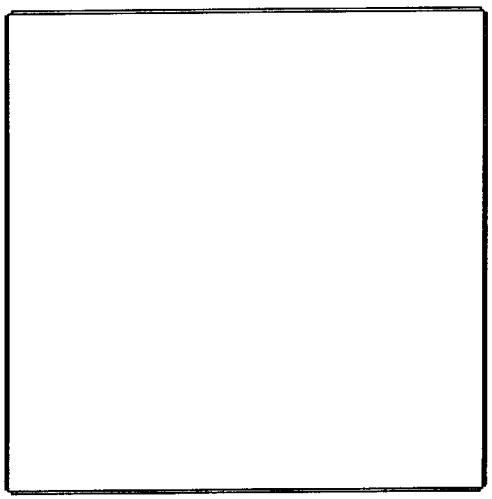
Fig. 4D PRIOR ART
FIG. 4D is a bottom plan view of the diffuser of FIG. 4A.
Figure 4B:
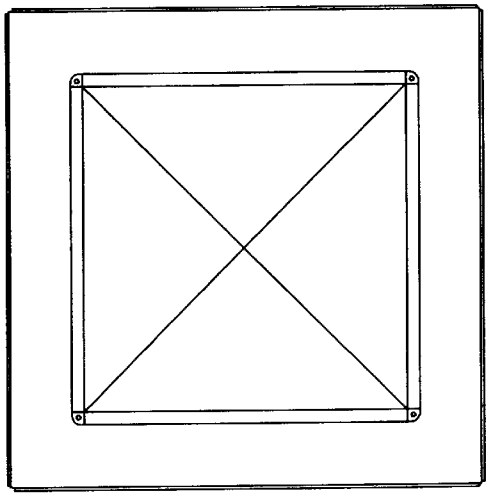
Fig. 4B PRIOR ART
FIG. 4B is a top plan view of the diffuser of FIG. 4A.
Figure 4C:
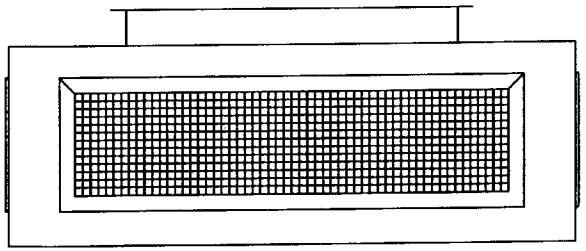
FIG. 4C is a side plan view of the diffuser of FIG. 4A.
Figure 5A:
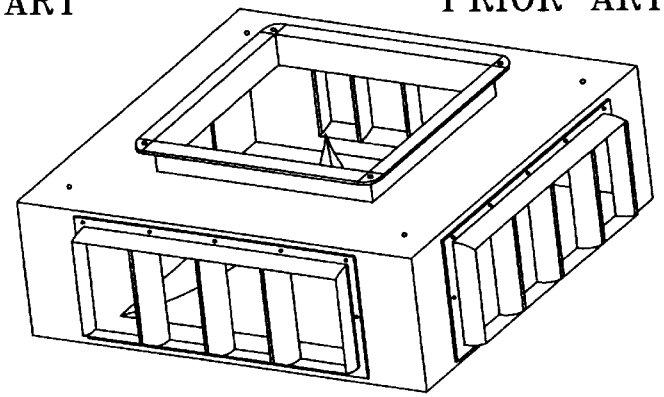
Fig. 5A PRIOR ART
FIG. 5A is a top perspective view of a fourth prior art diffuser design.
Figure 5D:
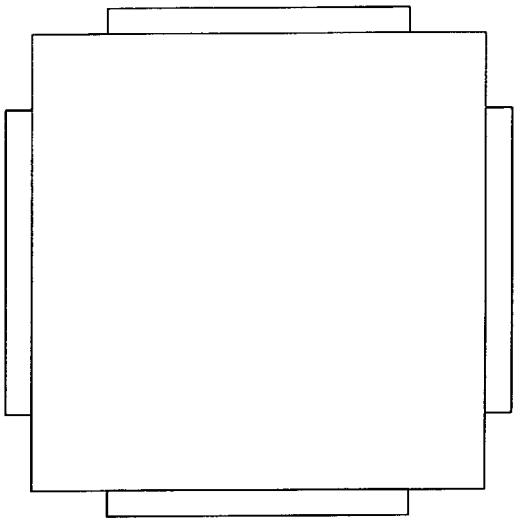
Fig. 5D PRIOR ART
FIG. 5D is a bottom plan view of the diffuser of FIG. 3A.
Figure 5B:
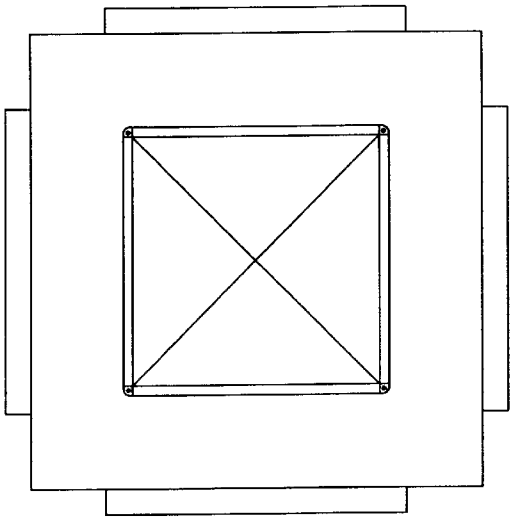
Fig. 5B PRIOR ART
FIG. 5B is a top plan view of the diffuser of FIG. 5A.
Figure 5C:
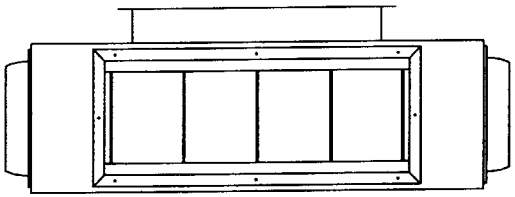
FIG. 5C is a side plan view of the diffuser of FIG. 5A.
Figure 6B:
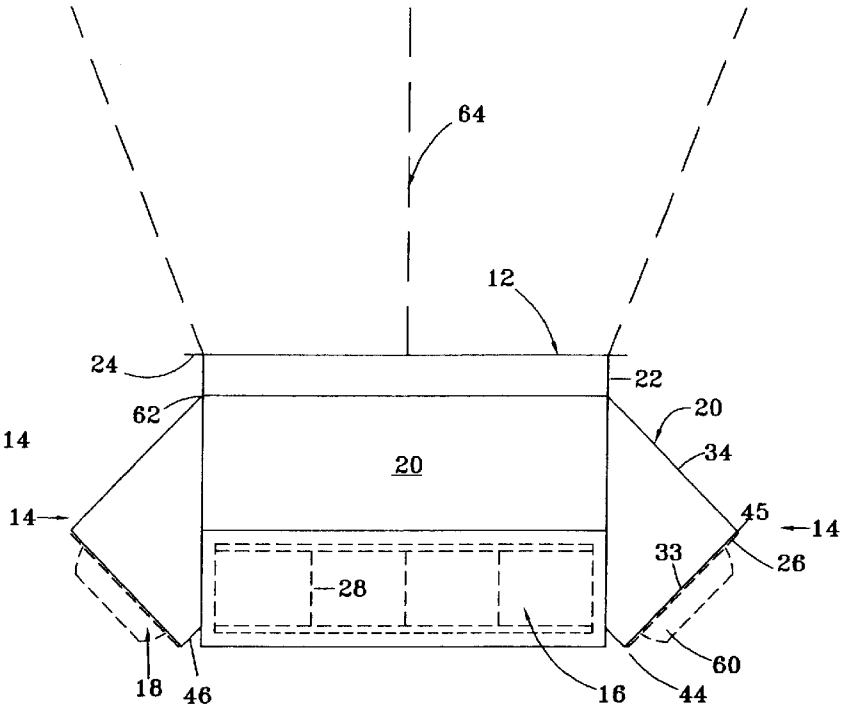
FIG. 6B is a side plan view of the diffuser of FIG. 6A.
Figure 6A:
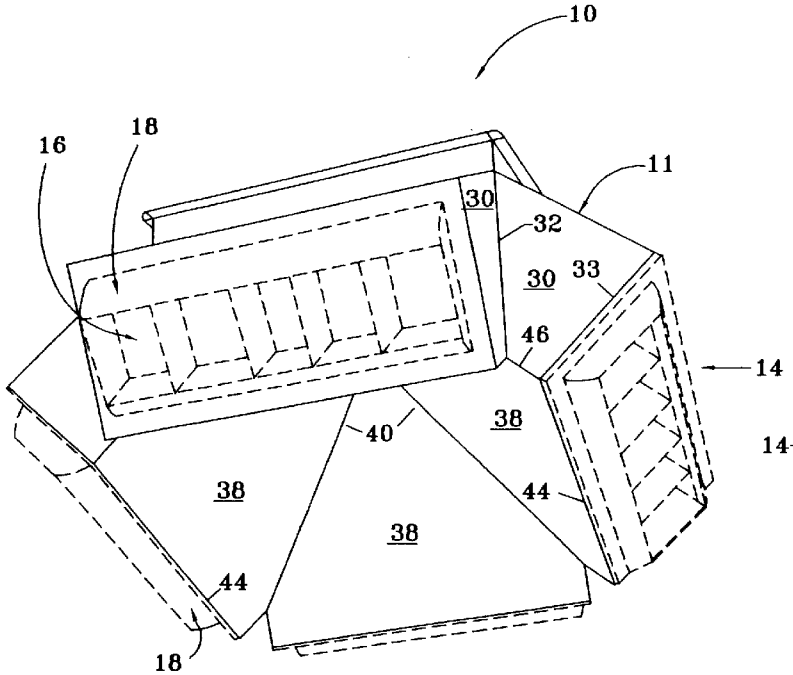
FIG. 6A is a bottom perspective view of the presently preferred embodiment, illustrating a four-way air diffuser with the vents shown in phantom.

The vents 18 of the preferred embodiment are illustrated in FIGS. 6A–6B; however, a variety of other vent designs could be utilized as well. Some vents have a grid covering as is illustrated in FIGS. 1A, 3A and 4A. Other vent designs are of a more open construction as shown in FIGS. 5A and 5C. Some vents employ multi-directional louvers while others are substantially unidirectional. Furthermore, some vent designs may allow for movement of the vent 18 once installed, or may allow for the installation at a variety of possible angular relationships. The vents 18 illustrated have louvers 28 which are fixed relative to the vent 18.

The sides 14 have an upper surface 20 which preferably connects with an upper portion 22. The upper portion preferably has a flange 24. The flange 20 may be formed with a transverse duct connection (TDC) machine or through other methods known in the art. The flange 20 is preferably utilized to connect the diffuser 10 to the transition duct (illustrated in phantom in FIG. 6B). The upper portion 22 communicates with a duct as illustrated in FIG. 6B to provide air into the cavity 16.

The sides also preferably have a vent receiver 26 which connects with the upper surface 20. The vent receiver 26 connects the vent 18 to the rest of the diffuser 10. The vent receiver 26 may allow for off the shelf vents 18 to be utilized. The vent receiver 26 may also be a portion of the vent 18 allowing a vent 18 to be connected directly to at least one of the upper surfaces 20, side surfaces 30, or bottom surfaces 38. The vent receiver 26 is also illustrated connected to side surfaces 30 at side-vent intersections 33. Adjacent side surfaces 30 are illustrated intersecting at side intersection 32. The side surface is also shown connected to the upper surface 20 at upper intersection 34.

Figure 6D:
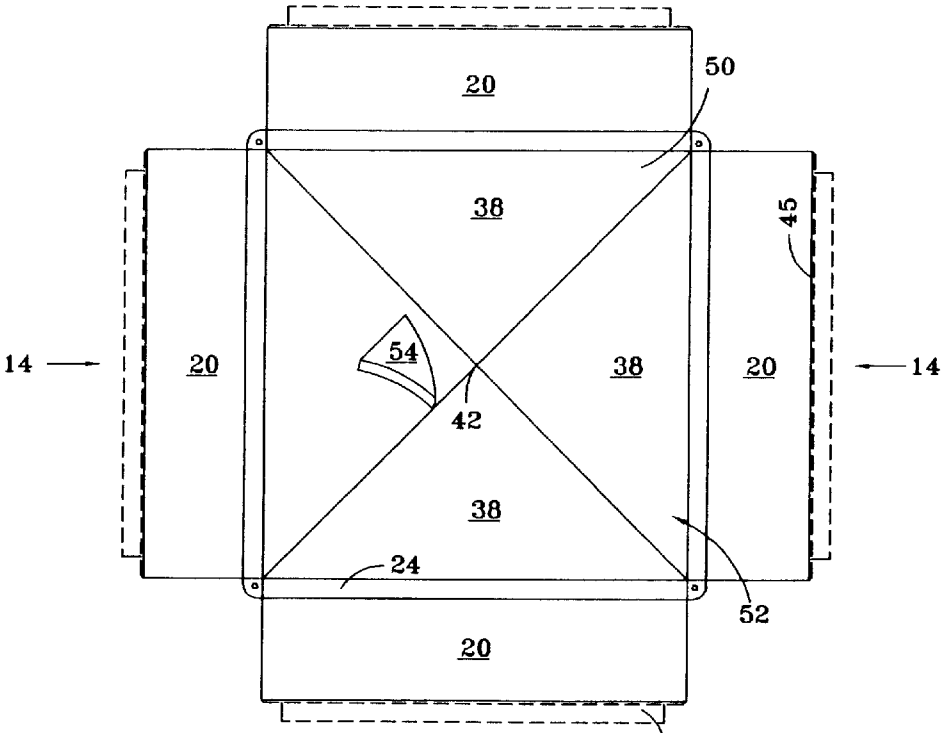
FIG. 6D is a top plan view of the diffuser of FIG. 6A with a portion of insulation pulled away from the deflector illustrated in perspective.
Figure 6C:
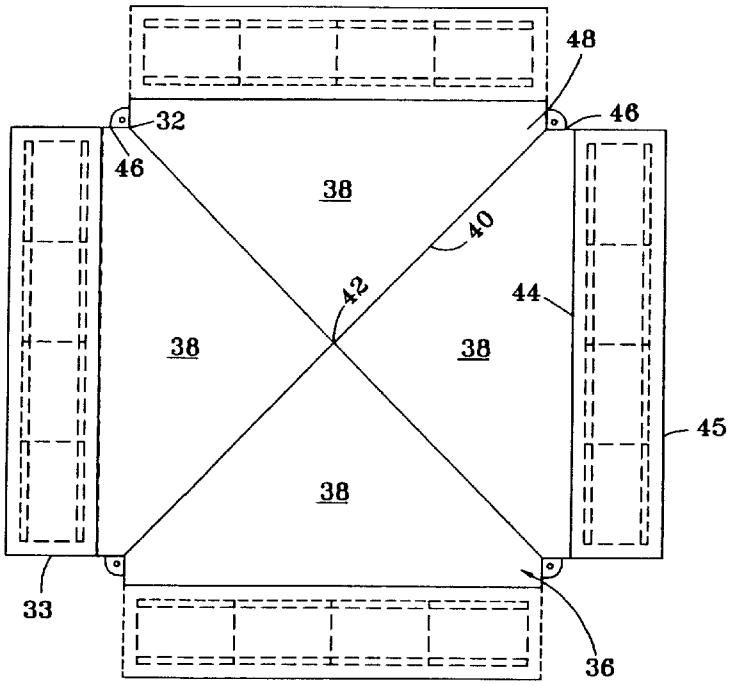
FIG. 6C is a bottom plan view of the diffuser of FIG. 6A.

FIGS. 6A and 6C show the bottom 36 of the diffuser 10. The bottom 36 is preferably constructed of bottom panels 38. The bottom panels 38 intersect one another at bottom intersections 40. The bottom intersections 40 preferably connect at a top member, such as apex 42, such that the bottom panels 38 are connected to form a multi-sided pyramid-like shape lacking a bottom. The apex 42 is preferably at an elevation, a predetermined distance, above a bottom portion 60 of the vent 18. Additionally, the apex 42 is preferably at about the same elevation as a top portion 62 of the upper surface 20. In some construction techniques, the top member may take on another shape such as a line as illustrated in FIGS. 8A, 8E, 8F, 8G, 9A, 9B, 9D, and 9E. Also, the top member may have other shapes so that the defelctor 52 could have a pyramid-like shape with the top portion (or point) of the pyramid angled or removed. In the presently preferred embodiment, a four sided pyramid shape is formed. Furthermore, the bottom panels connect to the vent receivers 26 and side surfaces 30 at lower intersection 44 and bottom-side surface intersection 46.

The deflector 52 is positioned such that the top member is located at an elevation substantially similar to that of the top of the upper surfaces 20. Furthermore, the angles of the bottom panels relative to the axis 64 illustrated in FIG. 6B is between about 110 and 160 degrees, and more precisely between about 120 and 150 degrees. It is believed that the actual angle illustrated is approximately 135 degrees. The deflector 10 positioned in this manner has been found efficient at distributing air to desired locations within a space.

The exterior surface 48 of the bottom panel 38 has an opposing interior surface 50. The interior surfaces 50 of the four bottom panels 38 are illustrated in FIG. 6D. The interior surfaces 50 form a deflector 52 which directs air entering through the inlet 12 out of the vents 18. The deflector 52 may extend a predetermined distance beyond the side intersection 32 which is believed to assist in precise distribution of air throughout a desired space.

As illustrated in FIG. 6D, the deflector 52 resembles a pyramid-like shape. The deflector 52 is also preferably covered with an insulating material to assist in preventing condensation from forming on the deflector itself. In many applications, a difference in humidity and temperature between the air introduced into a space by the diffuser 10 and the air already in the space may result in condensation forming on a portion of the diffuser 10. The use of insulation 54 reduces the tendency for condensation to form on the diffuser 10.

The upper surface 20 of the preferred embodiment is substantially parallel to the deflector 50 in order to assist in directing air to a desired location. Furthermore the lower intersection 44 and the upper-vent receiving intersection 45 are preferably substantially planar along with the side-vent intersections 33 to receive the vent receivers 26.

Of course, the bottom panels 38 are illustrated as being planar and most likely constructed of separate pieces of sheet metal. Nevertheless a manufacturer could make two or more panels 38 by bending a single sheet of metal. Furthermore, the bottom panels 38 could be curved in a similar fashion as the prior art insert illustrated in FIGS. 2A–2E is constructed. Although the sides would be curved, the shape of the deflector 52 would still be a pyramid like shape. Also vanes, similar to the planar members of the prior art insert could be utilized within the diffuser 10 to assist in the distribution of air flow.

FIGS. 7A–7E illustrate the first alternative embodiment providing for a six-way diffuser 110. The six-way diffuser has an inlet 112, six sides 114, and a cavity 116 similar to the four-way design. Six vents 118 direct air into a desired space. Six upper surfaces 120 are utilized to direct air in addition to the deflector 150. The upper surfaces 120 may be connected to connectors 121 which connect with the upper section 122. The upper section 122 may have flanges to connect with a transition duct (not shown) in a similar fashion as the four way design connects with a transition duct.

Air enters the diffuser 110 through the inlet 112 and enters the cavity 116. The air then contacts the deflector 152 and is directed out the vents 118. In this first alternatively preferred embodiment, there are six directions instead of four directions which the air may exit the diffuser 110. Also in this embodiment, the upper surface 120 may assist in directing air along with the deflector 152. Once again, the deflector 152 is comprised of the interior surface 150 of the bottom panels 138 as is shown in FIG. 7D.

Figure 7B:
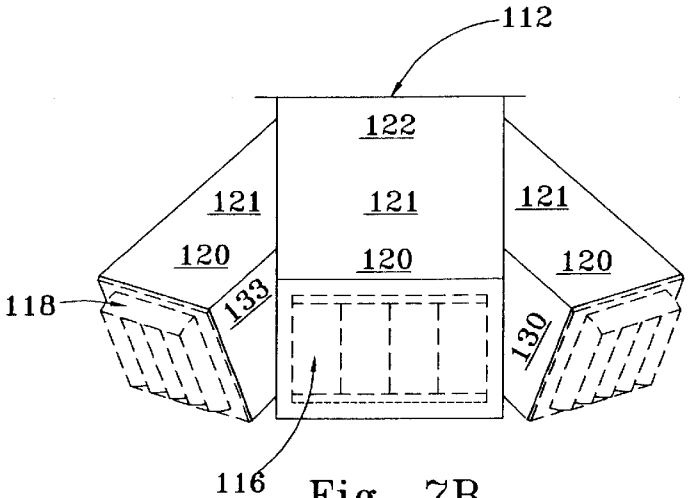
FIG. 7B is a side plan view of the diffuser of FIG. 7A.
Figure 7C:
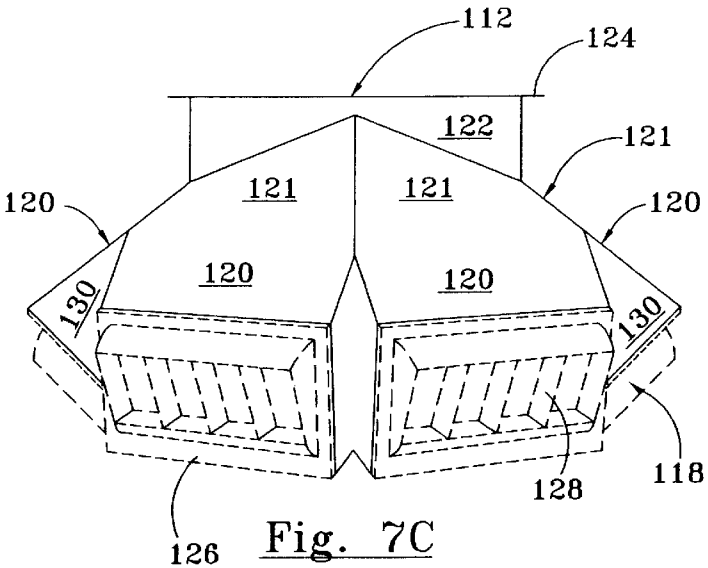
FIG. 7C is a side plan view of the diffuser of FIG. 7A with the diffuser turned 30 degrees relative to the view of 6B.
Figure 7A:
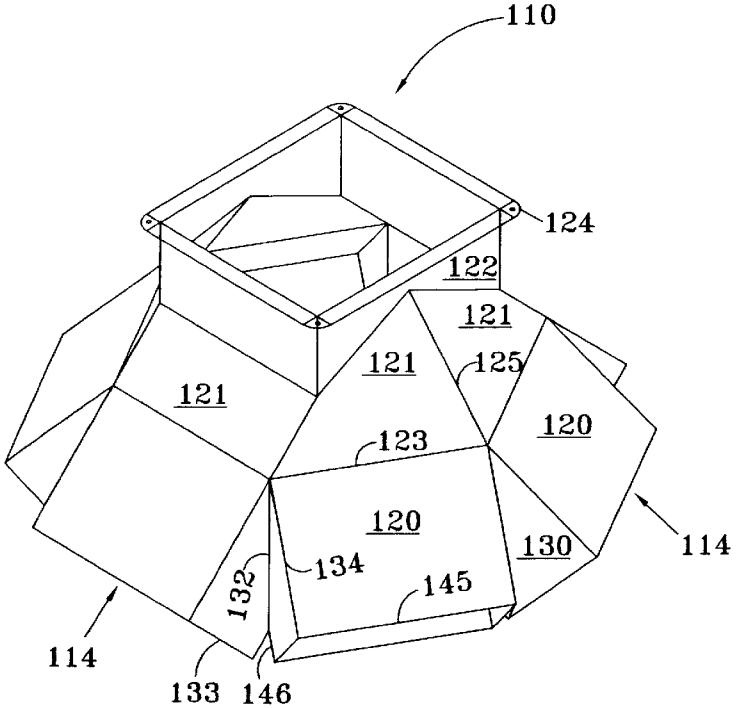
FIG. 7A is a top perspective view of an alternatively preferred embodiment, illustrating a six-way air diffuser with the vents and vent receivers removed.

FIG. 7A illustrates the upper portion 122 connected to the connectors 121, should they be utilized. The top of upper section 122 includes flange 124 for connecting with a transition duct (not shown). The connectors 121 connect to the upper section 120 that connector-upper intersection 123. The connectors 121 connect with each other at connector intersections 125. The upper sections 120 connect with the side surfaces 130 at upper intersections 134. The side surfaces 30 connect with other side surfaces at side intersections 132. The upper section 120 connects with the vent receiver 126 at upper-vent receiving intersection 145.

Figure 7E:
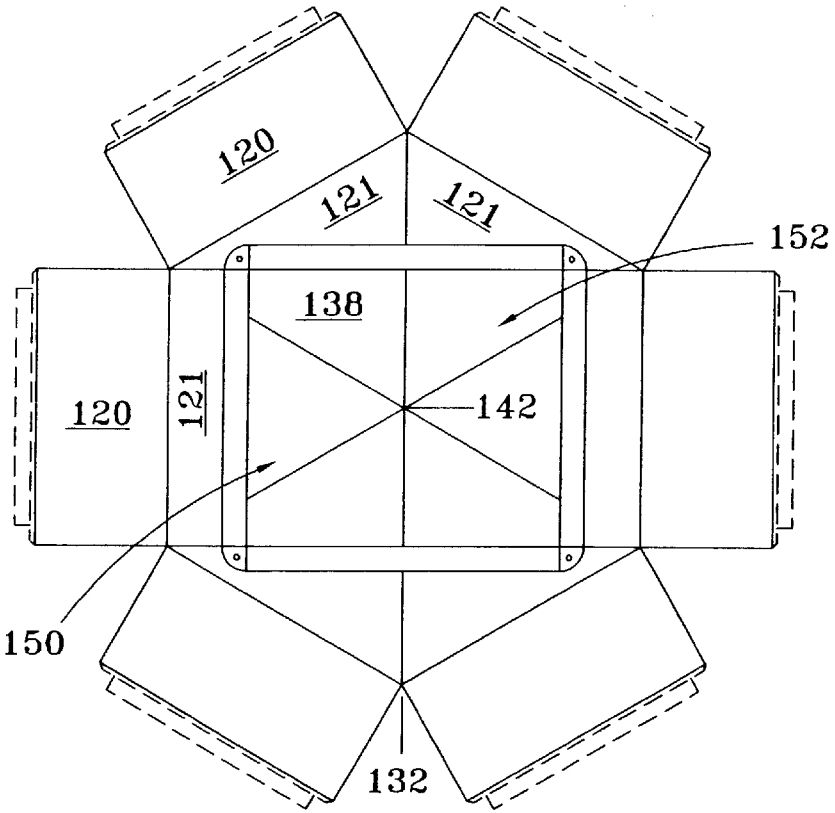
FIG. 7E is a top plan view of the diffuser of FIG. 7A.
Figure 7D:
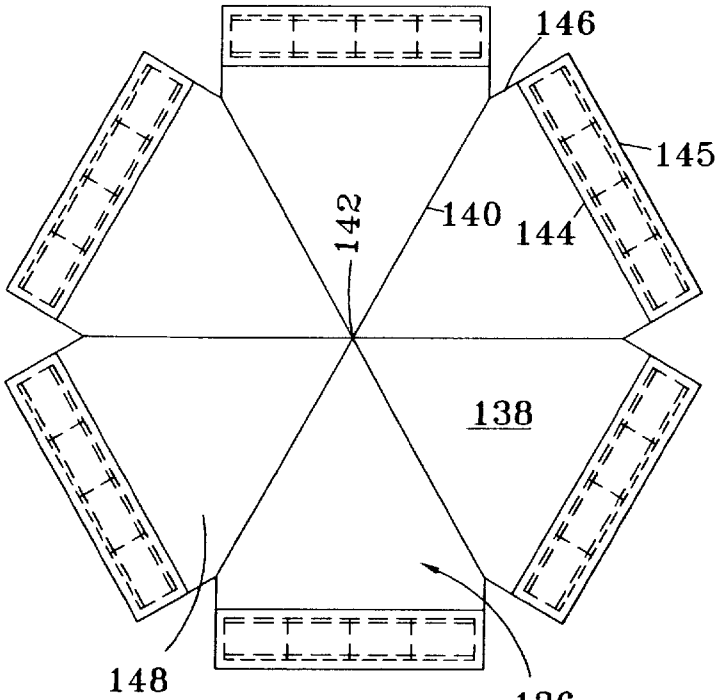
FIG. 7D is a bottom plan view of the diffuser of FIG. 7A.

Turning to FIGS. 7D and 7E the bottom 136 of the diffuser 110 is illustrated having an apex 142 where the bottom panels 138 meet at a point of intersection. The bottom panels 138 connect with each other at bottom intersection 140. The bottom panels 138 connect with the vent receiver at lower intersection 144. The bottom panels 138 and side surfaces 130 connect at bottom-side surface intersection 146. Additionally, the side surfaces 130 and vent receivers 126 intersect at side-vent intersections 133. The upper-vent receiving intersection 145 is also illustrated in FIG. 7D. Once again, the interior surfaces 150 of the bottom panels 138 form a deflector 152 as is illustrated in FIG. 7E. Additionally, in this embodiment, it is preferred that the deflector 152 extend a distance beyond the side intersections 132. The deflector 152 is also a pyramid-like shape having six triangular sides comprised of bottom panels 138 with no base.

In a second alternatively preferred embodiment illustrated in FIGS. 8A through G, a three way diffuser 210 is illustrated. The three way diffuser receives air from inlet 212 as air passes to within the cavity 216. From the cavity 216 air is expelled out the sides 214 through vents 218. As air is expelled from the three-way diffuser 210, air is expelled through vents 218 which are received by the vent receiver 226. Louvers 228 may also be utilized to direct the flow of air from the diffuser 210.

The upper surface 220 preferably connects with the upper portion 222 which is equipped with flanges 224 for mating with a transition duct (not shown). Side surfaces 230 connect with the upper surfaces 220 at upper intersections 234. The side surfaces 230 connect with other side surfaces at side intersections 232. The bottom panels 238 connect with the side surfaces 230 at bottom-side surface intersections 246. The side surfaces 230 connect with the vent receivers 226 at side-vent intersection 233. The upper surfaces 220 connect with the vent receivers 226 at upper-vent receiving intersections 245. The bottom 236 is comprised of bottom panels 238 which join at bottom intersections 240. A top member illustrated as a linear junction 242 may be located where the three bottom panels 238 intersect.

In the second alternatively preferred embodiment, air is directed in three ways instead of four or six ways as is provided by the other embodiments. Nevertheless, in this embodiment the deflector 252 is comprised of the interior surfaces 250 of the bottom panels 238. Additionally, the deflector 252 preferably extends a predetermined length beyond the side intersections 232 which is believed to assist in precisely directing air to a specific location.

Figure 8B:
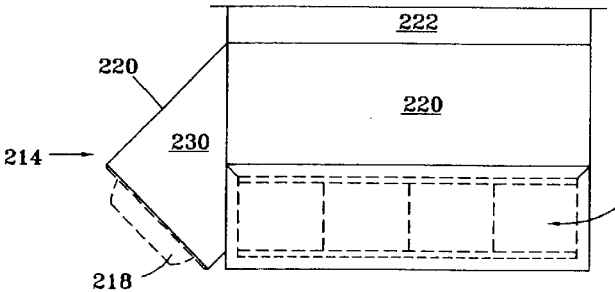
FIG. 8B is a side plan view of the diffuser of FIG. 8A as viewed from the right of the embodiment illustrated in FIG. 8A.
Figure 8C:
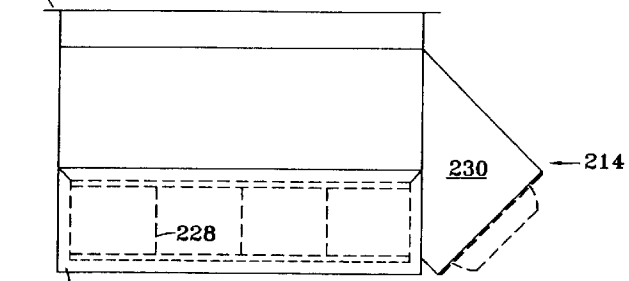
FIG. 8C is a side plan view of the diffuser of FIG. 8A as viewed from the left of the embodiment illustrated in FIG. 8A.
Figure 8E:
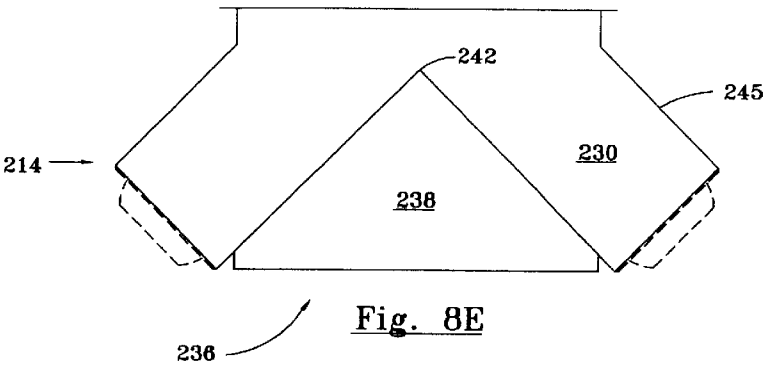
FIG. 8E is a side plan view of the diffuser of FIG. 8A as viewed from the back of the embodiment illustrated in FIG. 8A.
Figure 8A:
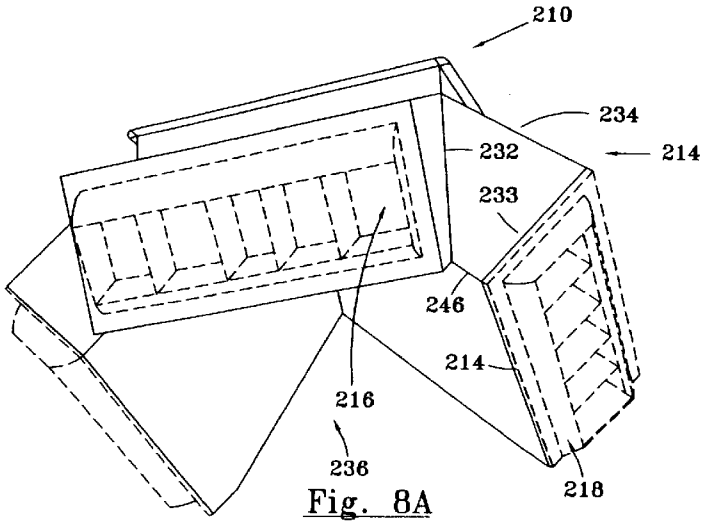
FIG. 8A is a bottom perspective view of a second alternatively preferred embodiment, illustrating a three-way air diffuser with the vents shown in phantom.
Figure 8D:
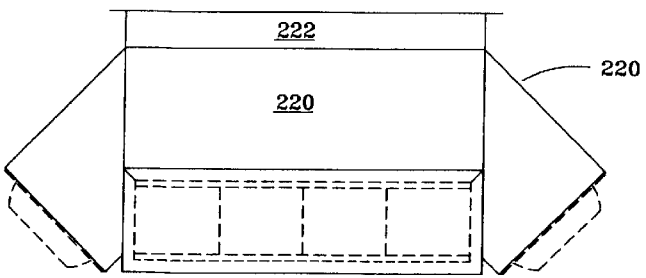
FIG. 8D is a side plan view of the diffuser of FIG. 8A as viewed from the front of the embodiment illustrated in FIG. 8A.
Figure 8G:
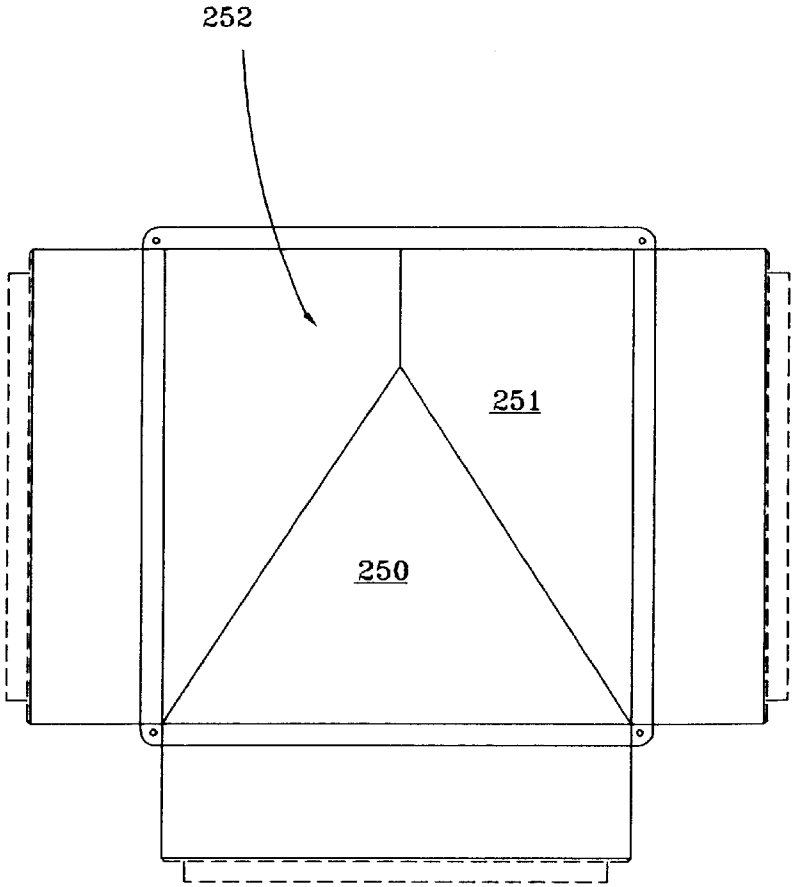
FIG. 8G is a top plan view of the diffuser of FIG. 8A.
Figure 8F:
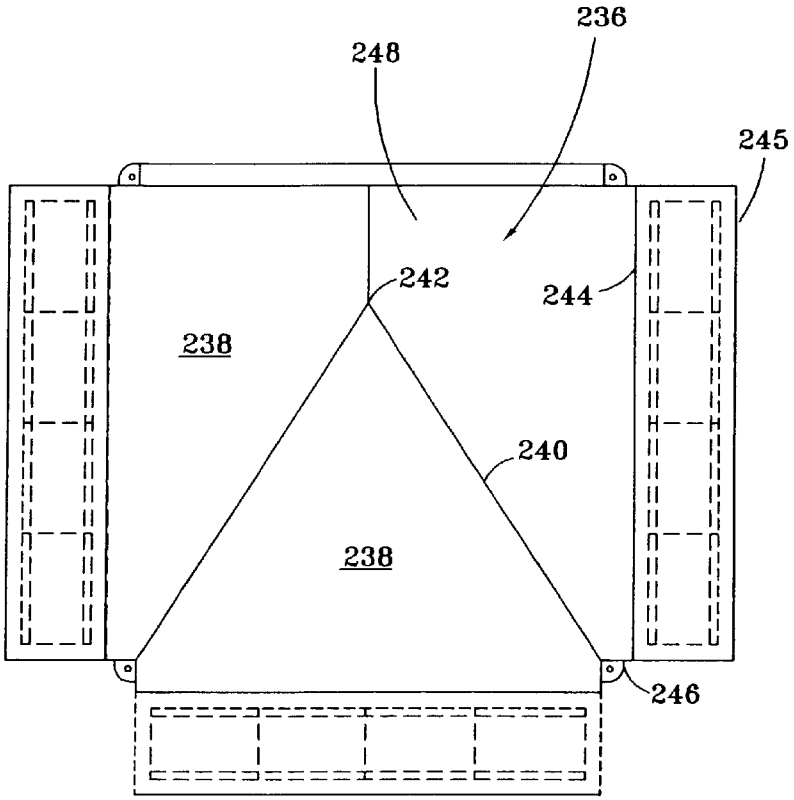
FIG. 8F is a bottom plan view of the diffuser of FIG. 8A.

In this embodiment, the bottom panels 238 may have different shapes from one another as is illustrated in FIGS. 8F and 8G. Specifically the interior surfaces 250 and 251 are different. This not necessarily need be the case, it is possible that the three directions could be 120° apart instead of 90° as illustrated. Furthermore, this illustration shows that the directional flow of air from the diffusers 10, 110, 210, 310 need not be symmetrical about a center of the diffuser design. Furthermore, the sides of the pyramid-like shape need not be triangular, nor symmetrical.

Figures 9A, 9B, 9C:
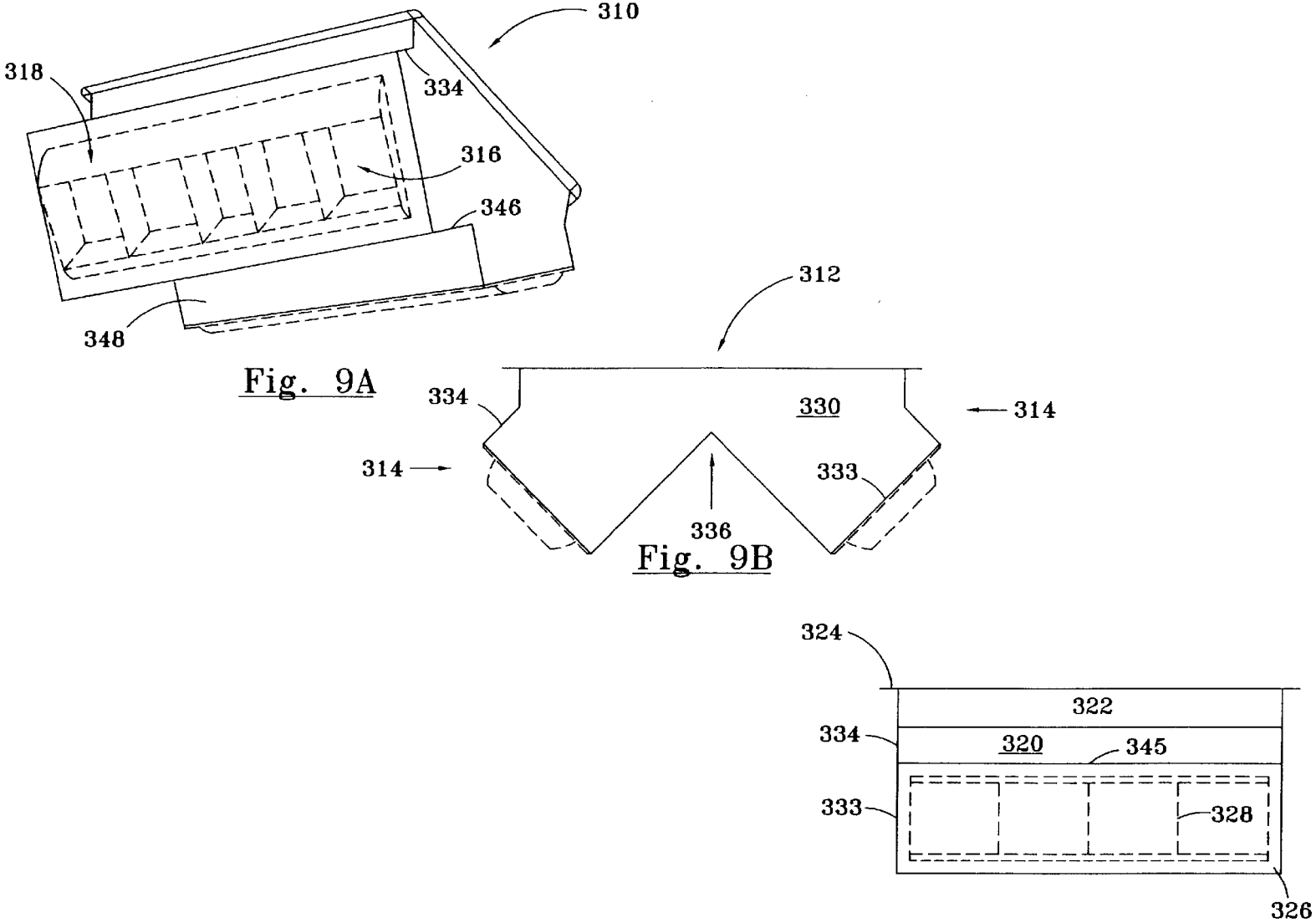
FIG. 9A is a bottom perspective view of a third alternatively preferred embodiment, illustrating a two-way air diffuser with the vents shown in phantom.
FIG. 9B is a side plan view of the diffuser of FIG. 9A as viewed from the right of the embodiment illustrated in FIG. 9A.
FIG. 9C is a side plan view of the diffuser of FIG. 9A with the diffuser turned 90 degrees relative to the view of 9B.
Figure 9E:
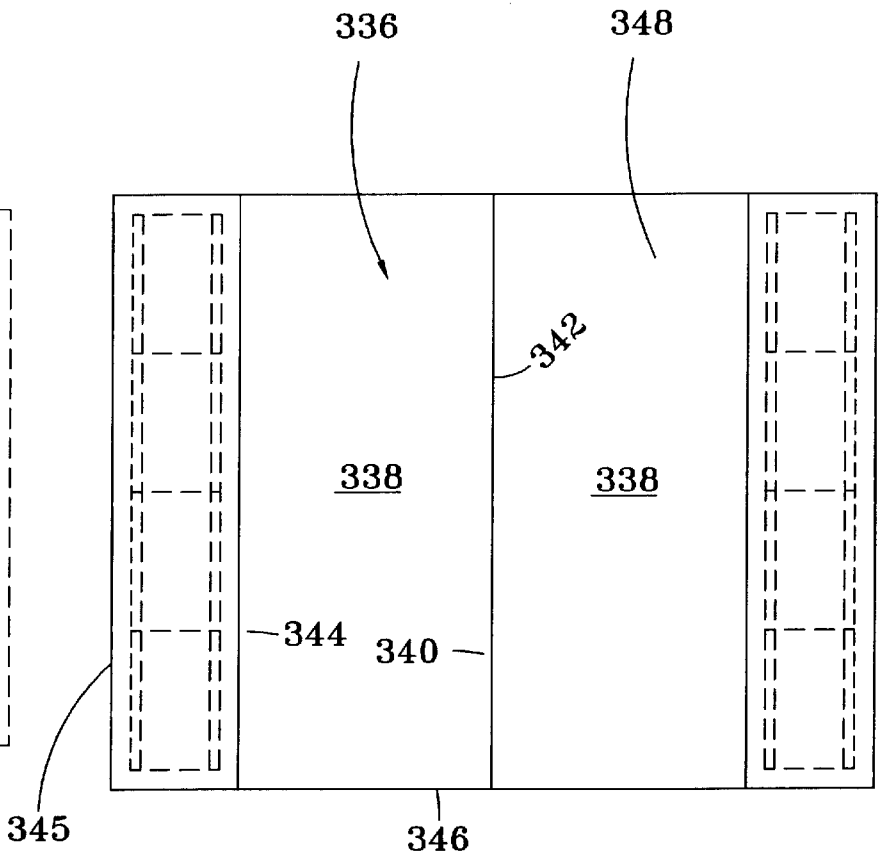
FIG. 9E is a bottom plan view of the diffuser of FIG. 7A.
Figure 9D:
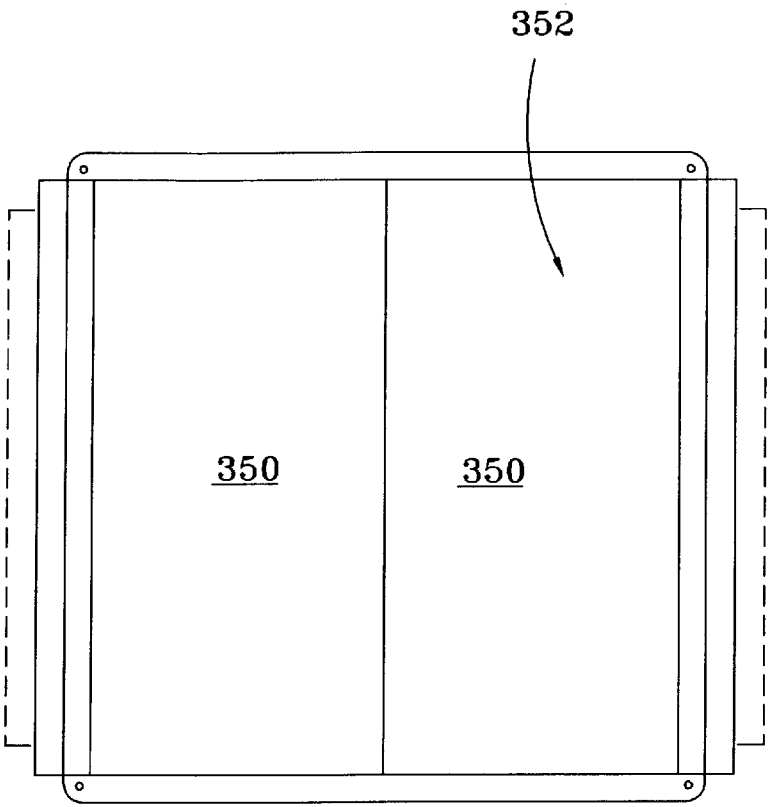
FIG. 9D is a top plan view of the diffuser of FIG. 7A.

A third alternatively preferred embodiment is illustrated in FIGS. 9A through 9C, a two-way diffuser 310. Air enters the two-way diffuser 310 through inlet 312 and passes into cavity 316. From the cavity 316, the air will be expelled through vents 318. Upper surfaces 320 connect with upper portions 322 as is illustrated in FIG. 9C. The upper portion 322 has a flange 324 for connecting with a transition duct (not shown). The upper surfaces 320 also connect with a vent receiver 326 at upper-vent receiving intersections 345. In this embodiment, it may not be necessary that side surfaces 330 connect with one another at a side intersections 332. Nevertheless, the upper sections 320 and the side surfaces 330 intersect at upper intersections 334. The side surfaces 330 intersect the vent receiver 326 at side-vent intersections 333. The bottom 336 of the diffuser 310 is comprised of bottom panels 338.The bottom panels 338 intersect one another at bottom intersection 340 which also forms the top member 342. The bottom panels 338 intersect the vent receiver 326 at lower intersections 344. Furthermore, the bottom panels 338 intersect the side surfaces 330 at bottom-side surface intersections 346. The exterior surface 348 of the bottom panel 338 is illustrated in FIG. 9E. The opposing interior surface 350 of the exterior surface 348 illustrated in FIG. 9E is illustrated in FIG. 9B. The interior surface 350 of the bottom panel 338 form deflector 352 which directs air to desired locations within a space. Although not composed of triangular shaped sides, the deflector 352 is a representation of two-sided pyramid without a base.

While preferred embodiments of the invention have been described above, it is to be understood that any and all equivalent realizations of the present invention are included within the scope and spirit thereof. Numerous alterations of the embodiments herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

I claim:

1. An air diffuser comprising:

a housing having a cavity therein, at least two sides, and an inlet;

said inlet located above at least a portion of the cavity;

a plurality of vents located on said at least two sides of the housing; and said housing having a bottom comprised of a plurality of bottom panels having exterior and corresponding interior surfaces, said plurality of bottom panels corresponding in number to the number of vents, the bottom panels oriented to meet at a top member at a first predetermined distance above a bottom portion of at least one of the plurality of vents, and the interior surfaces of said bottom panels forming at least a portion of a deflector.

2. The air diffuser of claim 1 wherein the inlet has an axis and each of said plurality of vents are oriented at an angle relative to the axis of the inlet.

3. The air diffuser of claim 1 wherein the bottom panels are substantially planar.

4. The air diffuser of claim 1 wherein the housing further comprises upper surfaces, side surfaces and side intersections wherein adjacent side surfaces intersect at side intersections, said side surfaces connect with the bottom panels at bottom-side surface intersections, and the side surfaces connect with the upper surfaces at upper intersections, said upper sections substantially parallel to respective bottom panels.

5. The air diffuser of claim 4 wherein the deflector extends a second predetermined distance beyond the side intersections.

6. The air diffuser of claim 4 wherein the top member is substantially at the same elevation as a top portion of the upper surfaces of the sides.

7. The air diffuser of claim 1 wherein the bottom panels are angled between 110 and 160 degrees relative to the axis of the inlet.

8. The air diffuser of claim 7 wherein the panels are angled between about 120 and 150 degrees relative to the axis of the inlet.

9. The air diffuser of claim 8 wherein the panels are angled at about 135 degrees relative to the axis of the inlet.

10. The air diffuser of claim 1 wherein the top member further comprises an apex.

11. The air diffuser of claim 1 wherein at least a portion of the interior surfaces of the bottom panels are insulated.

12. The air diffuser of claim 1 wherein the plurality of vents and said at least two sides of the housing correspond in number.

13. The air diffuser of claim 12 wherein the diffuser has four sides.

14. An air diffuser for use in a climate control system providing air to a desired space comprising:

a housing having a cavity therein, at least two sides, and an inlet;

said inlet providing air communication from the climate control system with the cavity;

a vent located on each of said at least two sides of the housing, said vents providing air communication between the cavity and the desired space; and said housing having a bottom comprised of a plurality of bottom panels having exterior and corresponding interior surfaces, said plurality of bottom panels corresponding in number to the number of sides of the housing, the bottom panels forming a pyramid-like shape, and the interior surfaces of said bottom panels forming at least a portion of a deflector.

15. The air diffuser of claim 14 wherein the bottom panels are substantially planar.

16. An air diffuser for use in a climate control system providing air to a desired space comprising:

a housing having a cavity therein, at least three sides, and an inlet, adjacent sides of said at least three sides meeting at side intersections;

said inlet providing air communication from the climate control system with the cavity;

at least one vent located on each of the at least three sides of the housing, said at least one vents providing air communication between the cavity and the desired space; and said housing having a bottom comprised of a plurality of bottom panels having exterior and corresponding interior surfaces, said plurality of bottom panels corresponding in number to the number of sides of the housing, the bottom panels forming a pyramid-like shape meeting at an apex, and the interior surfaces of said bottom panels forming a deflector wherein the deflector extends a predetermined distance beyond said side intersections.

* * * * *